United States Patent [19]

Palmer et al.

[11] 4,054,117

[45] Oct. 18, 1977

[54] OIL PRESSURE FAILURE PROTECTION DEVICE FOR INTERNAL COMBUSTION ENGINES

[76] Inventors: Howard J. Palmer, 68 Gaywood Place, Moraga, Calif. 94556; James R. Bechard, 314 Perkins St., Oakland, Calif. 94610

[21] Appl. No.: 653,209

[22] Filed: Jan. 28, 1976

[51] Int. Cl.[2] ..... F02B 77/00

[52] U.S. Cl. ..... 123/198 D; 123/148 S

[58] Field of Search .... 123/198 DC, 198 D, 198 DB, 123/148 S, 142

[56] References Cited

U.S. PATENT DOCUMENTS

| | | | |
|---|---|---|---|
| 3,601,103 | 8/1971 | Swiden | 123/198 DC X |
| 3,726,265 | 4/1973 | Howard | 123/198 DC X |
| 3,884,203 | 5/1975 | Cliffgard | 123/198 DC X |
| 3,960,128 | 6/1976 | Anderson et al. | 123/198 DC X |
| 3,964,461 | 6/1976 | Wesemeyer et al. | 123/198 DC |

*Primary Examiner*—Carroll B. Dority, Jr.
*Assistant Examiner*—Ira S. Lazarus
*Attorney, Agent, or Firm*—Harris Zimmerman

[57] ABSTRACT

A device for slowing an internal combustion engine in the event of oil pressure failure at an engine speed above idle, includes an SCR with the gate thereof connected through a resistor to the field winding of the engine generator. The SCR is connected between an oil pressure sensing switch typically provided for the engine, and the ignition distributor points. Should the oil pressure switch close, indicating low oil pressure, and the engine is turning at sufficient speed so that the generator field provides enough voltage to the SCR gate, the SCR will fire and short the ignition.

3 Claims, 4 Drawing Figures

OIL PRESSURE FAILURE PROTECTION DEVICE FOR INTERNAL COMBUSTION ENGINES

BACKGROUND OF THE INVENTION

Modern automobiles and trucks are provided with sensors and warning systems which monitor the working functions of the vehicle engine and apprise the operator of serious malfunction. A major operating parameter of an internal combustion engine is the pressure of the lubricating oil, and any disruption of the lubricating system pressure is usually signalled by a dashboard warning light.

In internal combustion engines which are air cooled, and which rely on the lubricating system both for cooling and lubrication, failure of the lubricating system is a catastrophic event. Should the oil pressure fall significantly, and the engine continues in operation, the engine will destroy itself in a matter of a few seconds. The main bearings of the crankshaft will erode, the cylinder walls may be scored, and the engine may seize.

It is an unfortunate yet commonplace aspect of human nature that a vehicle operator who is concentrating on driving may ignore a dashboard light and be totally unaware of an engine malfunction. Should the oil pressure fail at freeway cruising speeds, the driver will barely have time to stop the vehicle before the engine is damaged, even if he or she reacts immediately to the warning light. Clearly, a mere dashborad warning light system is insufficient.

The following United States Patents exemplify the state of the art in devices which react to stop engine operation in the event of oil pressure failure:

3,914,735, 3,116,729, 3,601,103, 2,771,068, 3,362,388, 2,445,625, 3,384,062, 2,191,216.

Of these patents, U.S. Pat. No. 2,191,216 relates most directly to the present invention, in that it shows the engine to idle in the event of oil pressure failure, and that it senses idle speed by the voltage generated by the engine generator. However, this prior art system utilizes a solenoid device which must continuously energized, unlike the present invention as detailed in the following.

SUMMARY OF THE INVENTION

The present invention generally comprises a device for sensing the oil pressure of an internal combustion engine, and slowing the engine to idle speed should the oil pressure fall below a predetermined minimum. The invention includes an SCR with one electrode connected through a diode to the oil pressure switch typically provided for the standard oil pressure warning system in a vehicle. The gate of the SCR is connected through a resistor to the field winding of the engine generator. The other electrode of the SCR is connected directly to the ignition distributor points. The voltage from the generator passing across the resistor is sufficient to turn on the SCR only when the engine is turning at a rate above idle speed.

Should the oil pressure fall, the pressure switch will close and ground the one electrode of the SCR. If the generator voltage is sufficient to gate the SCR, the SCR will turn on and connect the distributor points to ground. The engine will immediately stall, slowing until it reaches idle speed. At that point, the generator voltage will be insufficient to operate the SCR gate, and the SCR will turn off. Thus the device will maintain the engine at idle speed while the oil pressure is low. Th pressure warning light, together with the gover action of the device, will notify the driver of the er malfunction. Further, the limiting of the engine tc speed will minimize the damaging effects of the la proper lubrication.

THE DRAWING

DESCRIPTION OF THE PREFERRED EMBODIMENT

Figure 1:
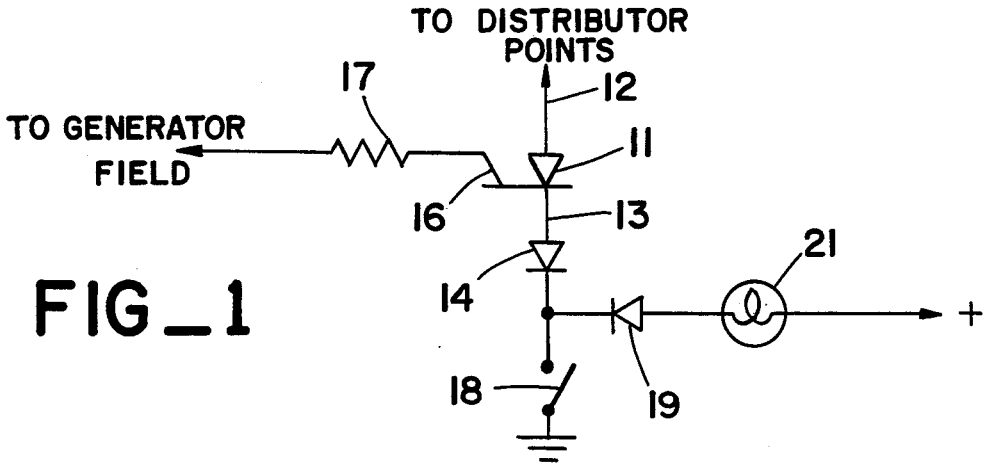
FIG. 1 is a schematic view of the circuit of one bodiment of the present invention.

The present invention is generally described as vice for protecting an internal combustion engine oil pressure failure or other serious or destructiv function. As shown in FIG. 1, one embodiment invention includes an SCR 11 which has one ele 12 connected to the distributor points of the engin gate of the SCR is connected to a resistor 17, wl turn is connected to the field winding of the generator. The electrode 13 of the SCR is conne a forward biased diode 14, which is connected normally open oil pressure sensing switch 18 vehicle. It should be noted that the switch 18 n direct connection to ground when the oil pressu below a predetermined value.

A dashboard warning light is connected to a voltage on one side, and to a forward biased diod the other side. The diode 19 is connected to a p switch 18. The resistor 17 serves both to limit t current applied to the gate 16, and to act as a divider to apply only a small portion of the field to the gate. Diode 14 is required to prevent voltage from the indicator light from back bia SCR. The diode 19 serves to prevent field above battery voltage levels from actuating the tor light 21. If the indicator lamp 21 is not provi diodes 14 and 19 are not required.

The voltage applied to the gate of the SCR cient to fire the SCR only when the engine is tu generator at nominal cruising speed. Should pressure fall to an unsafe level, the switch 18 w The SCR is already fired by the generator field so that the distributor points are connected thr SCR and the switch 18 to ground. The spark thus prevented from firing and the engine stal As the engine slows to a nominal idle speed, erator field voltage falls until the voltage app the gate 16 of the SCR 11 is insufficient to fire The SCR turns off and the distributor poin longer shorted to ground. Thus the engine is l idle speed by the invention. It may be appreci the value of the resistor 17 determines the which the engine is limited during oil pressu since it controls the amount of the generato applied to the SCR gate.

Figure 2:
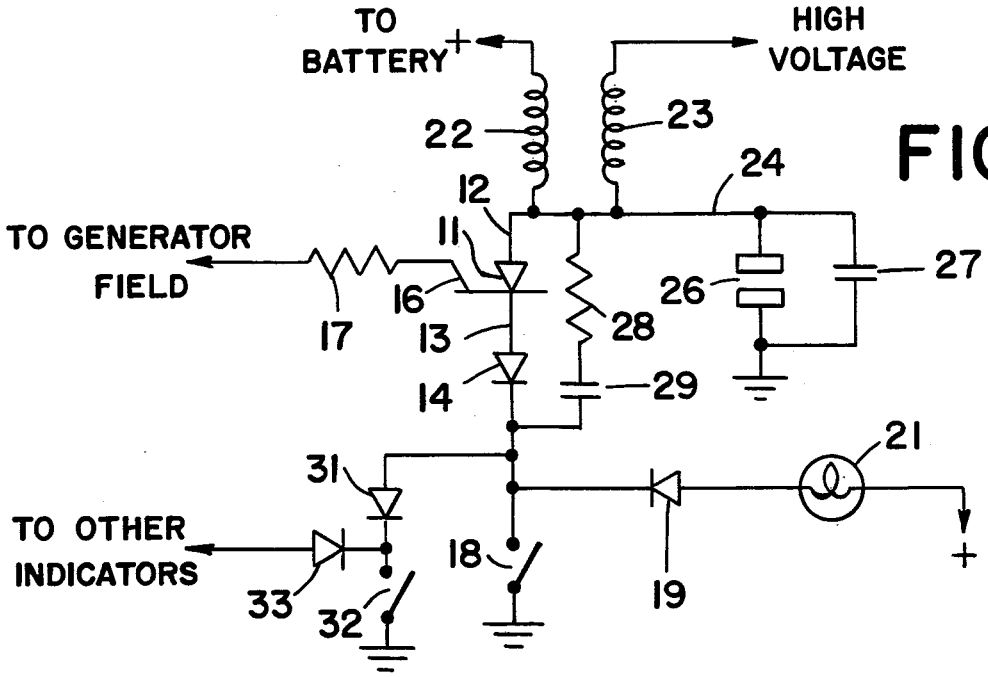
FIG. 2 is a schematic view of the circuit of an embodiment of the present invention.

In the embodiment shown in FIG. 2, the 11–14 and 16–21 are connected and function previous embodiment. The electrode 12 of tl connected to the junction point 24, to whic mary winding 22 and the secondary winding ...ed between junction point 24 ...rk comprising a resistor 28 and a capacitor 29. This RC network serves to shunt the high voltage peaks generated by the ... of the spark coil 22-23 around the SCR, so ...le SCR will be free of any potential damage from ...h voltage, and so that the voltage peaks will not ... the SCR. If a high voltage SCR is used, the RC ...k is not necessary.

...connected to the ground side of the diode 14 is ...ard biased diode 31, to which a grounding-type ... sensor switch 32 is connected. The switch 32 ...mprise an engine temperature switch, a fire sen- ...the like. If the switch 32 is provided with a dash- ...ndicator light, the light will be connected to the ... side of the diode 32. Other switches and indica- ...y be connected in a like manner. Should any of ...ches 18, 32, etc., close, and the engine is operat- ...ve idle speed, the distributor points will be con- ...o ground and the engine will be limited to idle ...s before.

...uld be noted that the protective device of the ...n draws virtually no current from the electrical ...of the engine when it is operating. It draws ... only during an oil pressure failure crisis, an ...hich occurs infrequently during the life of an ... Thus the device conserves energy and fuel, ...ior art arrangements.

Figure 3:
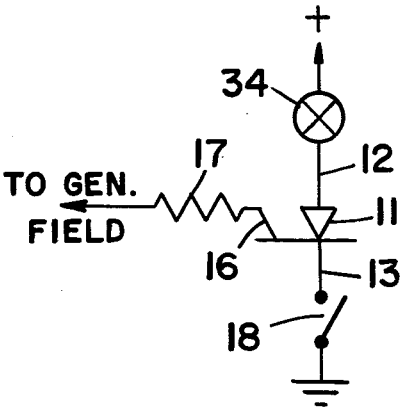
FIG. 3 is a schematic view of a further embodim the present invention.

... embodiment shown in FIG. 3, the elements ...d 16–18 are again employed as before. The ...: 12 of the SCR is connected to an alarm device ...h in turn is connected to positive battery volt- ...uld the switch 18 close and the SCR fire, the ...ll be connected to ground and will emit an ...nal to warn the operator of engine oil pressure ... other malfunction.

Figure 4:
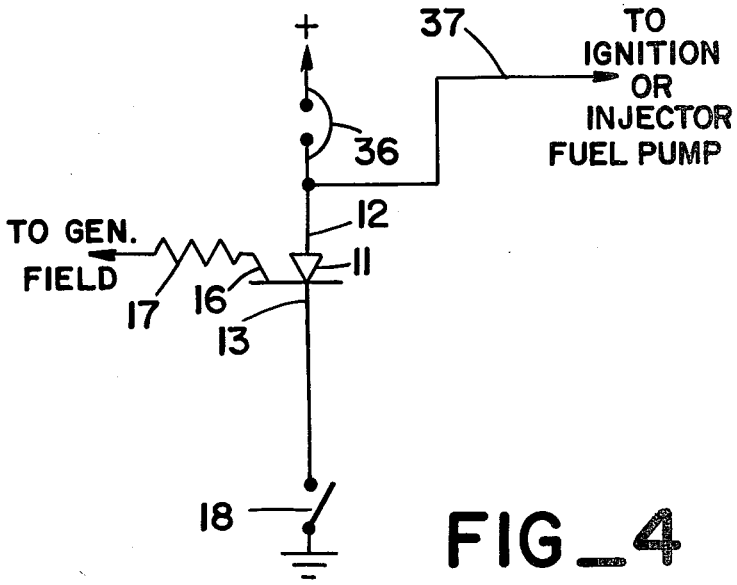
FIG. 4 is a schematic view of the circuit of y other embodiment of the present invention.

...bodiment depicted in FIG. 4 is designed for ...junction with fixed installation internal com- ...gines such as generating stations or the like. ...rode 12 of the SCR 11 is connected to the ...eaker 36 which is usually provided with such ...llation engines. The circuit breaker is in turn ... to the positive pole of the engine battery. ...nected to the electrode 12 is a conductor 37 ...onnected to the ignition circuit of the engine, ... to the distributor points (in the case of a spark ...e), or to the pump of the fuel injection system ...e of a diesel engine or the like). The circuit ...3–18 are connected as in the previous em- ...nection of the gate 16 of the SCR through the ... to the generator field permits the engine to ...without firing the SCR. Should the switch 18 close while the engine is operating at normal speed, the voltage from the generator field will fire the SCR which will connect the battery directly through the circuit breaker and the switch 18 to ground. This short circuit will cause the circuit breaker to open, thereby severing the connection between the distributor points or pump and the battery. The engine will thus stop immediately. It should be noted that this embodiment will not reestablish the ignition when the engine slows below idle speed, as the circuit breaker will remain open.

It should be noted that the present invention does not interfere with the normal starting procedure of an engine. When the engine is being cranked by the starter motor, the oil pressure switch is closed until the engine starts and pressure is established. However, during cranking the generator field voltage is insufficient to fire the SCR 11. Therefore, the device is not actuated during starting.

The engine protective device of the present invention is advantageous in that it is simple and reliable, easily installed without disturbing the original equipment of the engine, and automatic in operation. Furthermore, it requires no power unless a malfunction occurs.

We claim:

1. In combination with an internal combustion engine having a generator powered electrical system and an ignition system including breaker points, an engine malfunction protection device including engine malfunction sensing means, engine speed limiting means actuated by said engine malfunction sensing means to limit the speed of said engine to a predetermined maximum during the occurrence of a malfunction, and engine speed sensing means, connected to said engine speed limiting means, to trigger said speed limiting means when said engine exceeds a predetermined speed; said speed limiting means including a solid state switching device having one electrode connected to said breaker points, said engine malfunction sensing means including a normally open switch having one pole connected to ground and the other pole connected to the other electrode of said solid state switching device, said speed sensing means including a resistor connected between the field winding of said generator and the gate of said solid state switching device.

2. The engine malfunction protection device of claim 1, further including a forward biased diode interposed between said other pole of said switch and said other electrode of said solid state switching device.

3. The engine malfunction protection device of claim 2, further including a series RC network connected between said one electrode of said solid state switching device and the low voltage side of said diode.

* * * * *